US006769459B2

(12) United States Patent
Ohara

(10) Patent No.: US 6,769,459 B2
(45) Date of Patent: Aug. 3, 2004

(54) METHOD FOR MAKING AN ELASTIC FABRIC FOR A DAMPER AND THE STRUCTURE THEREOF

(76) Inventor: Hiroshi Ohara, No. 104-3, Lane 190, Sec. 7, Chung-Shan N. Road, Taipei (TW)

( * ) Notice: Subject to any disclaimer, the term of this patent is extended or adjusted under 35 U.S.C. 154(b) by 260 days.

(21) Appl. No.: 10/160,592

(22) Filed: May 30, 2002

(65) Prior Publication Data

US 2003/0221740 A1 Dec. 4, 2003

(51) Int. Cl.[7] ..... D03D 15/08

(52) U.S. Cl. ..... 139/420 A; 139/420 R; 139/421; 139/422; 139/426 R; 442/182; 442/184

(58) Field of Search ..... 139/383 R, 420 R, 139/421, 426 R, 420 A; 442/182, 184, 197, 217

(56) References Cited

U.S. PATENT DOCUMENTS

| | | | | | |
|---|---|---|---|---|---|
| 5,527,597 | A | * | 6/1996 | Stanhope et al. | 442/184 |
| 5,694,981 | A | * | 12/1997 | Stanhope et al. | 139/383 R |
| 5,707,710 | A | * | 1/1998 | Zafiroglu | 428/151 |
| 5,958,804 | A | * | 9/1999 | Brown et al. | 442/192 |
| 6,250,193 | B1 | * | 6/2001 | Head | 87/2 |
| 6,446,471 | B1 | * | 9/2002 | Kaplancali | 66/192 |
| 6,623,681 | B1 | * | 9/2003 | Taguchi et al. | 264/211.15 |

* cited by examiner

*Primary Examiner*—John J. Calvert
*Assistant Examiner*—Robert H. Muromoto, Jr.

(57) ABSTRACT

An elastic fabric made of spandex and at least one fiber, wherein the spandex has a volume of 0.1 to 5.0% of the elastic fabric volume. The at least one fiber is composed of cotton, polyester and aramid, which has a volume of 99.0 to 95.0% of the elastic fabric. When the spandex, cotton, polyester and aramid are combined together according to the proportion, an elastic thread is extracted from spandex, cotton, polyester and aramid to be woven into the elastic fabric.

39 Claims, 1 Drawing Sheet

METHOD FOR MAKING AN ELASTIC FABRIC FOR A DAMPER AND THE STRUCTURE THEREOF

FIELD OF THE INVENTION

The present invention relates to a method for making an elastic fabric, and more particularly to a method of making an elastic fabric which has the combination of spandex, cotton, polyester and aramid. Each of the material is mixed at an appropriate proportion and then a thread is extracted to weave the elastic fabric. The fabric has high elasticity and wear-resistance so that the life span of the fabric is long.

BACKGROUND OF THE INVENTION

Dampers or cone edges are the most important elements for speakers or drums. The damper or the cone edge which has better elasticity to vibrate is able to present high quality acoustic characteristic. With good and sound quality, the device with the damper or the cone edge has longer life span.

The conventional damper or cone edge is using cotton as a base. The base is first immersed in a compound resin so as to allow the cotton to absorb the resin. When the resin is full of the cotton, the longitudinal and latitudinal fiber threads are fixed to different positions. When the cotton as well as the resin in the cotton is cured and hardened, the resin in the cotton is formed into a thin film. Then, the thin film is heated, pressed and cut to form a damper or cone edge with a pattern formed on a surface thereof.

Although the conventional damper or the cone edge is made of cotton and cotton has excellent characteristics to be combined with the resin, it still has drawbacks, such as:

1. Bad lateral strength: Because the damper or the cone edge is using cotton as a base, the damper or the cone edge is easy to wear and thus breakage of the damper or the cone edge occurs very often, which causes bad acoustic result.
2. Lack of elasticity: Because the elasticity is not as good as expected, the resonance effect is not as good as required.
3. Strength is low: Because the strength is low so that this kind of damper or cone edge is not able to cope with high power output. Thus, high quality speaker or musical instrument adapted to use this damper or cone edge is not able to perform high quality acoustic effect.

In order to overcome the foregoing, improvements have made to add in wire strings so as to strengthen longitudinal and latitudinal resistance to force. Although the addition of wire strings in the latitudinal and longitudinal directions is able to improve the overall performance, other drawbacks occur:

The wire strings damage the cutting mode dramatically. After repeating cutting the damper, the edge of the cutting mode will have small cutouts. The cutouts eventually lead to a consequence that the cutting mode needs to be replaced with a new one, which not only interrupts the production line, but also increases the manufacture cost.

The wire strings have an elasticity and strength far more better the cotton fiber, such that the damper of this kind will experience unbalance in areas when in practical use, which causes interference.

The inner or outer edge of the wire strings after being cut needs to be bent so as to avoid contact with other metal to create a circuit short and thus damage the entire device, which increase cost in labor to make the necessary adjustment to the edge of the completed damper or cone edge.

To overcome the shortcomings, the present invention intends to provide an improved method for making an elastic fabric for a damper to obviate the aforementioned problems.

SUMMARY OF THE INVENTION

The primary objective of the present invention is to provide an improved method for making a damper or a cone edge so as to meet needs.

Another objective of the present invention is to provide an improved elastic fabric which has high elasticity and endurance for pressure.

Still another objective of the present invention is to provide diversities for the manufacturer so as to produce different products with excellent pressure resistance and acoustic characteristic.

A further objective of the present invention is that the cutting mode for cutting the finished product to a desired shape and dimension will not be damaged in the cutting process so as to reduce production time and enhance production efficiency.

In order to accomplish the objectives, the method is focus on the elastic fabric for damper or cone edge for drums. The elastic fabric is composed of spandex, cotton, polyester and aramid. Each of the material is mixed in different proportions according to requirement. Extraction of an elastic thread from the mixed materials is performed and then the extracted elastic threads are woven into a fabric. The proportion of the materials of spandex, cotton, polyester and aramid is determined based on the output power and/or acoustic characteristics so that when the completed damper or cone edge is used, the acoustic characteristic is different from one another.

Other objects, advantages and novel features of the invention will become more apparent from the following detailed description when taken in conjunction with the accompanying drawings.

DETAILED DESCRIPTION OF THE INVENTION

Figure 1:
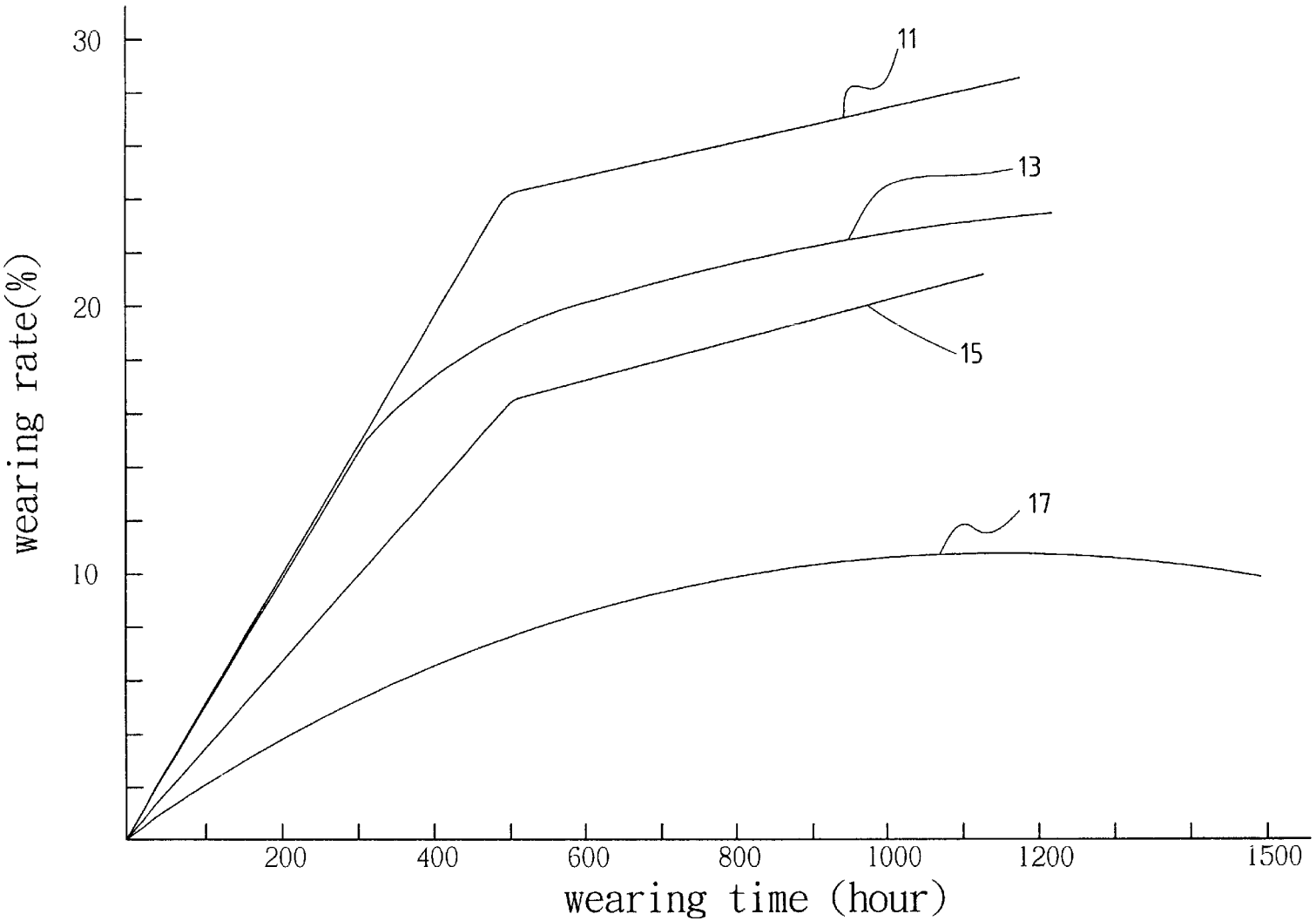
FIG. 1 is an endurance test showing the result of wearing rate versus time to dampers made of different materials respectively.

The method for making an elastic fabric for a damper for a speaker or a cone edge for a drum is using the spandex and at least one fiber mixed together. An elastic thread is extracted from the mixed materials and then the extracted elastic threads are woven into an elastic fabric. The spandex is 0.1 to 5.0% by volume of the total volume of the mixed materials. The spandex has high absorption to resin and therefore resin is able to attach to the spandex so that after the spandex is mixed with resin, the spandex together with the resin has very low hydrophilic feature, but has high elasticity and wear resistance. However, the endurance to heat of the spandex together with the resin is pretty low. The forming temperature of the spandex is 150° C.±10° C.

The at least one fiber includes cotton, polyester and aramid, which takes 99.9 to 95.0% of the entire volume of the mixed materials.

The cotton has high hydrophilic feature, yet the elasticity, heat resistance and wear resistance are low. The forming temperature of cotton is 245° C.±20° C.

The polyester has medium capability in absorbing resin such that the polyester has medium ability to be combined with the resin. The polyester has low hydrophilic feature, and heat resistance, yet the elasticity and wear resistance are high. The forming temperature is 200° C.±20° C.

The aramid has low absorption capability to resin so that the combination with the resin is low. However, the aramid has high hydrophilic feature, elasticity, wear resistance and heat resistance. The forming temperature is 235° C.±10° C.

The second embodiment of the present invention is to extract elastic threads from each of the foregoing materials and then the extracted elastic threads are woven into a weaving thread. Thereafter, the weaving thread is woven into an elastic fabric.

Generally, the spandex has very high elasticity. The stretched spandex may have a length ten times greater than the original length. In order to avoid the completed product to have too much elasticity, the spandex has a volume less than 5% of the entire volume. Accordingly, the spandex has a percentage of 0.1 to 5% of the entire volume and the remainder has a percentage of 95.0 to 99.9 of the entire volume.

The elastic fabric is composed of spandex, cotton, polyester and aramid. The proportion of the spandex is introduced and the proportions of the remainder can be any one of the followings:

1. Cotton 80 to 20%, Polyester 20 to 80% and Aramid 0%.
2. Cotton 20 to 80%, Polyester 0% and Aramid 80 to 20%.
3. Cotton 0%, Polyester 100% and Aramid 0%.
4. Cotton 0%, Polyester 0% and Aramid 100%.
5. Cotton 37.5%, Polyester 37.5% and Aramid 25%.
6. Cotton 42.5%, Polyester 32.5% and Aramid 25%.
7. Cotton 50%, Polyester 25% and Aramid 25%.
8. Cotton 0%, Polyester 50% and Aramid 50%.
9. Cotton 12.5%, Polyester 37.5% and Aramid 50%.
10. Cotton 17.5%, Polyester 32.5% and Aramid 50%.

Although there are several examples of the composition of the elastic fabric, numerous composition of the materials may also be made and thus accomplishes the objective of the present invention. Therefore, any one of the material may have a percentage from 100 to 0 and the remainder has a percentage from 0 to 100.

Another embodiment of the present invention may include the material of acrylic and silk. The percentage of acrylic is from 0.1 to 50 and the percentage of silk is from 99.9 to 50. The percentage of silk is from 0.1 to 25 and the percentage of silk is from 99.9 to 75.

Because the completed elastic fabric has a forming temperature between 175 to 250° C., which is higher than the forming temperature of spandex and lower than the forming temperature of cotton, polyester and aramid. Therefore, a reduce to the forming temperature of any one of the materials such as cotton, polyester and aramid is helpful to reduce the damage to the elasticity of the elastic fabric.

With reference to FIG. 1, in the endurance test, four different dampers each made of different material are compared with one another. It is to be noted that the wearing rate of the four different dampers is damper made of cotton 11>damper made of cotton and polyester (the cotton and polyester is 50% each) 13>damper made of aramid 15>damper of the present invention 17. According to the test result, the elastic fabric made by the method of the present invention has the least wearing rate and best resistance to pressure. That is, the elastic fabric of the present invention has the best elasticity.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making an elastic fabric for a damper or cone edge, comprising extracting an elastic thread from a combination of spandex, and at least one fiber composed of cotton, polyester and aramid, and weaving the elastic thread to the elastic fabric, wherein the spandex has a volume from 0.1 to 5.0% of the total volume of the elastic fabric and the cotton, the polyester and the aramid has a volume from 99.9 to 95.0% of the total volume of the elastic fabric, wherein the spandex has a forming temperature of 150° C.±10° C., the cotton has a forming temperature of 245° C.±20° C.

the polyester has a forming temperature of 200° C.±20° C.

the aramid has a forming temperature of 235° C.±10° C., whereby the elastic fabric has a forming temperature of 175 to 250° C., which is higher than the forming temperature of the spandex but lower than any of the remainder of the combination.

2. The method as claimed in claim 1, wherein the spandex has a volume less than 5% of the total volume of the elastic fabric.

3. The method as claimed in claim 1, wherein a proportion of the at least one fiber is divided into:

80 to 20% of the cotton, 20 to 80% of the polyester, and

0% aramid.

4. The method as claimed in claim 1, wherein a proportion of the at least one fiber is divided into:

20 to 80% of the cotton,

0% of the polyester, and 80 to 20% of the aramid.

5. The method as claimed in claim 1, wherein a proportion of the at least one fiber is divided into:

0% of the cotton,

100% of the polyester, and

0% of the aramid.

6. The method as claimed in claim 1, wherein a proportion of the at least one fiber is divided into:

0% of the cotton,

0% of the polyester, and

100% of the aramid.

7. The method as claimed in claim 1, wherein a proportion of the at least one fiber is divided into:

37.5% of the cotton, 37.5% of the polyester, and

25% of the aramid.

8. The method as claimed in claim 1, wherein a proportion of the at least one fiber is divided into:

42.5% of the cotton, 32.5% of the polyester, and

25% of the aramid.

9. The method as claimed in claim 1, wherein a proportion of the at least one fiber is divided into:

50% of the cotton,

25% of the polyester, and

25% of the aramid.

10. The method as claimed in claim 1, wherein a proportion of the at least one fiber is divided into:

0% of the cotton,

50% of the polyester, and

50% of the aramid.

11. The method as claimed in claim 1, wherein a proportion of the at least one fiber is divided into:

12.5% of the cotton, 37.5% of the polyester, and

50% of the aramid.

12. The method as claimed in claim 1, wherein a proportion of the at least one fiber is divided into:

17.5% of the cotton, 32.5% of the polyester, and

50% of the aramid.

13. A method for making an elastic fabric made of spandex and at least one fiber composed of cotton, polyester, and aramid for a damper or cone edge, comprising:

extracting an elastic thread from the spandex;

extracting an elastic thread from the polyester;

extracting an elastic thread from the cotton;

extracting an elastic thread from the aramid; and weaving the elastic threads from the spandex, the cotton, the polyester and the aramid to form the elastic fabric, wherein the spandex has a volume from 0.1 to 5.0% of the total volume of the elastic fabric and the cotton, the polyester and the aramid has a volume from 99.9 to 95.0% of the total volume of the elastic fabric, wherein the spandex has a forming temperature of 150° C.±10° C., the cotton has a forming temperature of 245° C.±20° C.

the polyester has a forming temperature of 200° C.±20° C.

the aramid has a forming temperature of 235° C.±10° C., whereby the elastic fabric has a forming temperature of 175 to 250° C., which is higher than the forming temperature of the spandex but lower than any of the remainder of the combination.

14. The method as claimed in claim 13, wherein the spandex has a volume less than 5% of the total volume of the elastic fabric.

15. The method as claimed in claim 13, wherein a proportion of the at least one fiber is divided into:

80 to 20% of the cotton, 20 to 80% of the polyester, and

0% aramid.

16. The method as claimed in claim 13, wherein a proportion of the at least one fiber is divided into:

20 to 80% of the cotton,

0% of the polyester, and 80 to 20% of the aramid.

17. The method as claimed in claim 13, wherein a proportion of the at least one fiber is divided into:

0% of the cotton,

100% of the polyester, and

0% of the aramid.

18. The method as claimed in claim 13, wherein a proportion of the at least one fiber is divided into:

0% of the cotton,

0% of the polyester, and

100% of the aramid.

19. The method as claimed in claim 13, wherein a proportion of the at least one fiber is divided into:

37.5% of the cotton, 37.5% of the polyester, and

25% of the aramid.

20. The method as claimed in claim 13, wherein a proportion of the at least one fiber is divided into:

42.5% of the cotton, 32.5% of the polyester, and

25% of the aramid.

21. The method as claimed in claim 13, wherein a proportion of the at least one fiber is divided into:

50% of the cotton,

25% of the polyester, and

25% of the aramid.

22. The method as claimed in claim 13, wherein a proportion of the at least one fiber is divided into:

0% of the cotton,

50% of the polyester, and

50% of the aramid.

23. The method as claimed in claim 13, wherein a proportion of the at least one fiber is divided into:

12.5% of the cotton, 37.5% of the polyester, and

50% of the aramid.

24. The method as claimed in claim 13, wherein a proportion of the at least one fiber is divided into:

17.5% of the cotton, 32.5% of the polyester, and

50% of the aramid.

25. A method for making an elastic fabric made of spandex and at least one fiber composed of cotton, polyester and aramid for a damper or cone edge, comprising:

extracting an elastic thread from the spandex;

extracting an elastic thread from the polyester;

extracting an elastic thread from the cotton;

extracting an elastic thread from the aramid; and weaving the elastic threads from the spandex, the cotton, the polyester and the aramid to form a primary elastic thread; and weaving the primary elastic thread to form the elastic fabric, wherein the spandex has a volume from 0.1 to 5.0% of the total volume of the elastic fabric and the cotton, the polyester and the aramid has a volume from 99.9 to 95.0% of the total volume of the elastic fabric, wherein the spandex has a forming temperature of 150° C.±10° C., the cotton has a forming temperature of 245° C.±20° C.

the polyester has a forming temperature of 200° C.±20° C.

the aramid has a forming temperature of 235° C.±10° C., whereby the elastic fabric has a forming temperature of 175 to 250° C., which is higher than the forming temperature of the spandex but lower than any of the remainder of the combination.

26. The method as claimed in claim 25, wherein the spandex has a volume less than 5% of the total volume of the elastic fabric.

27. The method as claimed in claim 25, wherein a proportion of the at least one fiber is divided into:

80 to 20% of the cotton, 20 to 80% of the polyester, and

0% aramid.

28. The method as claimed in claim 25, wherein a proportion of the at least one fiber is divided into:

20 to 80% of the cotton,

0% of the polyester, and 80 to 20% of the aramid.

29. The method as claimed in claim 25, wherein a proportion of the at least one fiber is divided into:

0% of the cotton,

100% of the polyester, and

0% of the aramid.

30. The method as claimed in claim 25, wherein a proportion of the at least one fiber is divided into:

0% of the cotton,

0% of the polyester, and

100% of the aramid.

31. The method as claimed in claim 25, wherein a proportion of the at least one fiber is divided into:

37.5% of the cotton, 37.5% of the polyester, and

25% of the aramid.

32. The method as claimed in claim 25, wherein a proportion of the at least one fiber is divided into:

42.5% of the cotton, 32.5% of the polyester, and

25% of the aramid.

33. The method as claimed in claim 25, wherein a proportion of the at least one fiber is divided into:

50% of the cotton,

25% of the polyester, and

25% of the aramid.

34. The method as claimed in claim 25, wherein a proportion of the at least one fiber is divided into:

0% of the cotton,

50% of the polyester, and

50% of the aramid.

35. The method as claimed in claim 25, wherein a proportion of the at least one fiber is divided into:

12.5% of the cotton, 37.5% of the polyester, and

50% of the aramid.

36. The method as claimed in claim 25, wherein a proportion of the at least one fiber is divided into:

17.5% of the cotton, 32.5% of the polyester, and

50% of the aramid.

37. An elastic fabric made of spandex and at least one fiber, wherein the spandex has a volume of 0.1 to 5.0% of the elastic fabric volume, and the at least one fiber is composed of cotton, polyester and aramid, which has a volume of 99.0 to 95.0% of the elastic fabric, wherein when combined together according to the proportion, an elastic thread is extracted to be woven into the elastic fabric.

38. An elastic fabric made of spandex and at least one fiber, wherein the spandex has a volume of 0.1 to 5.0% of the elastic fabric volume, and the at least one fiber is composed of cotton, polyester and aramid, which has a volume of 99.0 to 95.0% of the elastic fabric, wherein when combined together according to the proportion, an elastic thread is extracted from spandex, cotton, polyester and aramid to be woven into the elastic fabric.

39. An elastic fabric made of spandex and at least one fiber, wherein the spandex has a volume of 0.1 to 5.0% of the elastic fabric volume, and the at least one fiber is composed of cotton, polyester and aramid, which has a volume of 99.0 to 95.0% of the elastic fabric, wherein an elastic thread is extracted from spandex, cotton, polyester and the aramid respectively and each of the elastic threads are woven into a primary elastic thread according to the proportion, then the elastic fabric is woven by the primary elastic fabric.

* * * * *